US005794394A

United States Patent [19]

Bill et al.

[11] Patent Number: 5,794,394

[45] Date of Patent: Aug. 18, 1998

[54] ANCHOR BOLT CENTERING DEVICE

[76] Inventors: Joseph A. Bill, 23910 Cedar Creek Trc., Moreno Valley, Calif. 92557; Robert L. Bledsoe, 9300 Hunt Rd., Corona, Calif. 91719

[21] Appl. No.: 814,791

[22] Filed: Mar. 10, 1997

[51] Int. Cl.[6] ..... E04B 1/41

[52] U.S. Cl. ..... 52/295; 52/699; 52/712; 52/713; 52/715; 249/213; 249/190; 411/520; 411/526; 411/529; 411/918

[58] Field of Search ..... 52/698, 699, 701, 52/712, 713, 715, 293.3, 295; 249/213, 217, 218, 190, 91, 93, 202; 411/516, 518, 519, 520, 521, 526, 528, 529, 918

[56] References Cited

U.S. PATENT DOCUMENTS

| | | | |
|---|---|---|---|
| 1,323,067 | 11/1919 | Keith | 52/699 |
| 2,366,401 | 1/1945 | Haskell | 249/91 X |
| 3,182,939 | 5/1965 | Sackerson | 411/526 X |
| 3,274,680 | 9/1966 | Cruse | 52/713 X |
| 3,378,975 | 4/1968 | Hill | 52/713 X |
| 4,541,211 | 9/1985 | Garrett | 249/217 X |
| 4,736,554 | 4/1988 | Tyler | 52/295 X |
| 4,834,603 | 5/1989 | Holton | 411/521 |
| 4,872,298 | 10/1989 | Klemic, Jr. | 52/701 X |
| 5,146,720 | 9/1992 | Turner | 52/98 |
| 5,628,161 | 5/1997 | Giannuzzi et al. | 52/699 X |

*Primary Examiner*—Carl D. Friedman
*Assistant Examiner*—Laura A. Callo
*Attorney, Agent, or Firm*—Gene Scott-Patent Law & Venture Group

[57] ABSTRACT

A flat plate is used to cover a mounting hole in a masonry wall face and is held in place by a set of wire hooks. The hooks are able to slide into holes in the plate and catch onto the interior surface of the wall in order to hold a clearance hole in the plate concentrically with respect to the mounting hole. An anchor bolt is supported at the center of the mounting hole by the clearance hole in the plate while grout is poured into the masonry blocks thereby assuring that the bolt is positioned properly in accordance with building code.

2 Claims, 2 Drawing Sheets

ANCHOR BOLT CENTERING DEVICE

BACKGROUND OF THE INVENTION

1. Field of the Invention

This invention relates generally to anchor bolts used in construction for attaching wood framing to masonry, and more particularly to an anchor bolt assembly for centering such anchor bolts in mounting holes in a masonry wall.

2. Description of Related Art

Recent building code laws require that anchor bolts mounted in masonry walls provide for at least one inch of grout around the bolt on all sides. To accomplish this a one-inch bolt, for example, must be secured at the center of a three-inch hole prior to pouring the grout. Additionally, code requires that the grout extend from within the masonry wall to the exterior face of the wall. Current practice accomplishes this as follows:

1. Boring mounting holes in a masonry wall.

2. Placing anchor bolts, such as shown in FIG. 4 of the included drawings, into bolt holes in a plywood cover plate.

3. Supporting the plywood plate against the wall with the anchor bolts extending into the wall through the mounting holes.

4. Pouring grout into the masonry wall to secure the bolts within the wall.

5. Removing the plywood plate to expose the bolts.

Such practice generally does not result in centering of the bolts within the mounting holes so that code is not met. Further, the plate is usually long enough to support a line of bolts and is placed on the wall before placing the bolts. To enable this, the bolt holes must be large enough to accommodate the dog-leg conformation normally found in such anchor bolts so that they may be placed into the plate after it is mounted on the wall. This generally results in the bolts being held in a non-horizontal manner, presenting an appearance of sloppy work. Also, these plywood plates may be cupped or have other irregularities resulting in grout seeping onto the front face of the masonry.

The present invention overcomes these problems providing for a more accurate and faster placement of anchor bolts and for a neater job using less labor time.

SUMMARY OF THE INVENTION

The present invention teaches certain benefits in construction and use which give rise to the objectives described below.

The present invention provides a flat sheet metal plate with several wire hooks for engaging the inside surface of a masonry wall. The plate includes a hole for supporting an anchor bolt.

A primary objective of the present invention is to provide a means for centering and supporting anchor bolts during a grouting process, where the bolts must extend out of a masonry wall.

Another objective is to provide such a means being very inexpensive to produce and use and yet may be reused many times.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE PREFERRED EMBODIMENT

The above described drawing figures illustrate the invention, a mounting device for attachment to a masonry wall 10 for centering and supporting anchor bolts 40 during the grouting process.

Figure 2:
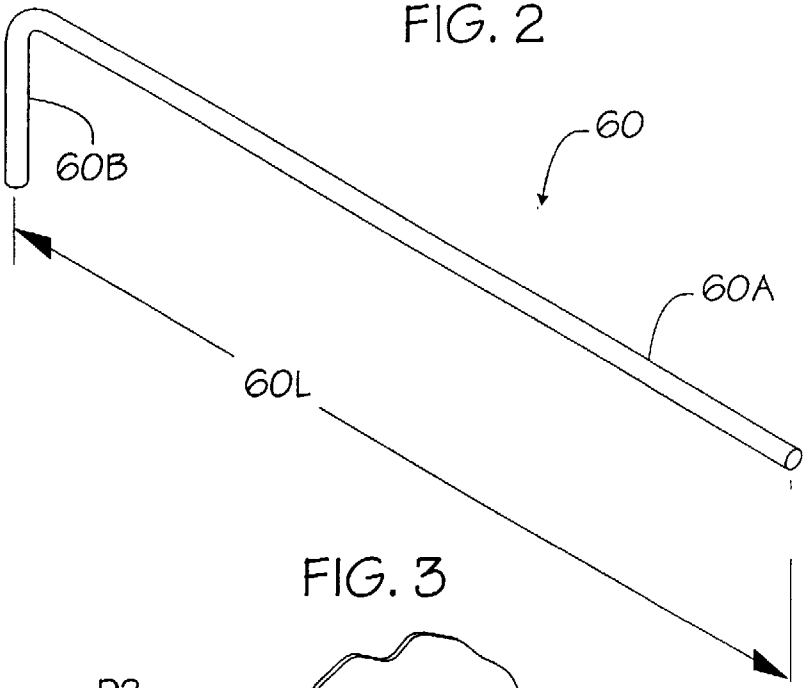
FIG. 2 is a perspective view of a wire hook thereof, one of at least three that are used with the flat plate.
Figure 3:
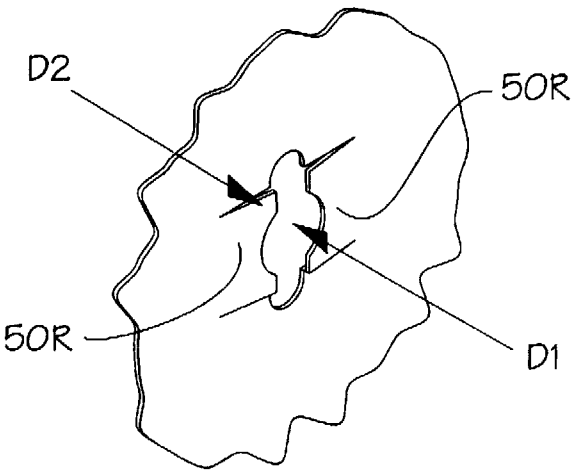
FIG. 3 is a partial view thereof taken along line 3—3 in FIG. 1 showing the preferred configuration of an aperture of the plate.
Figure 1:
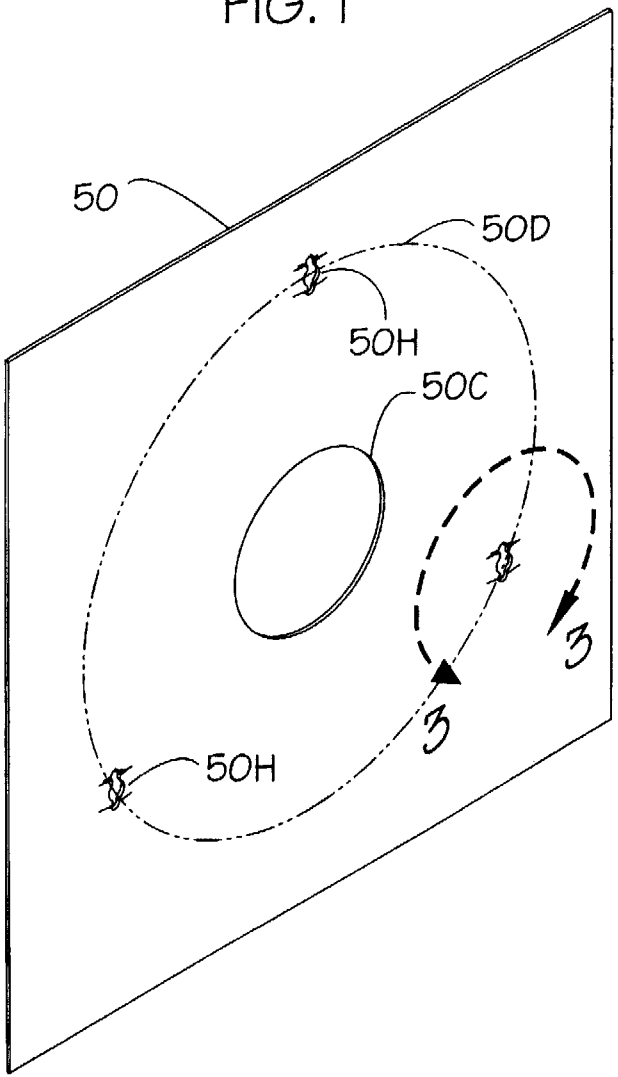
FIG. 1 is a perspective view of a flat plate of the present invention.
Figure 4:
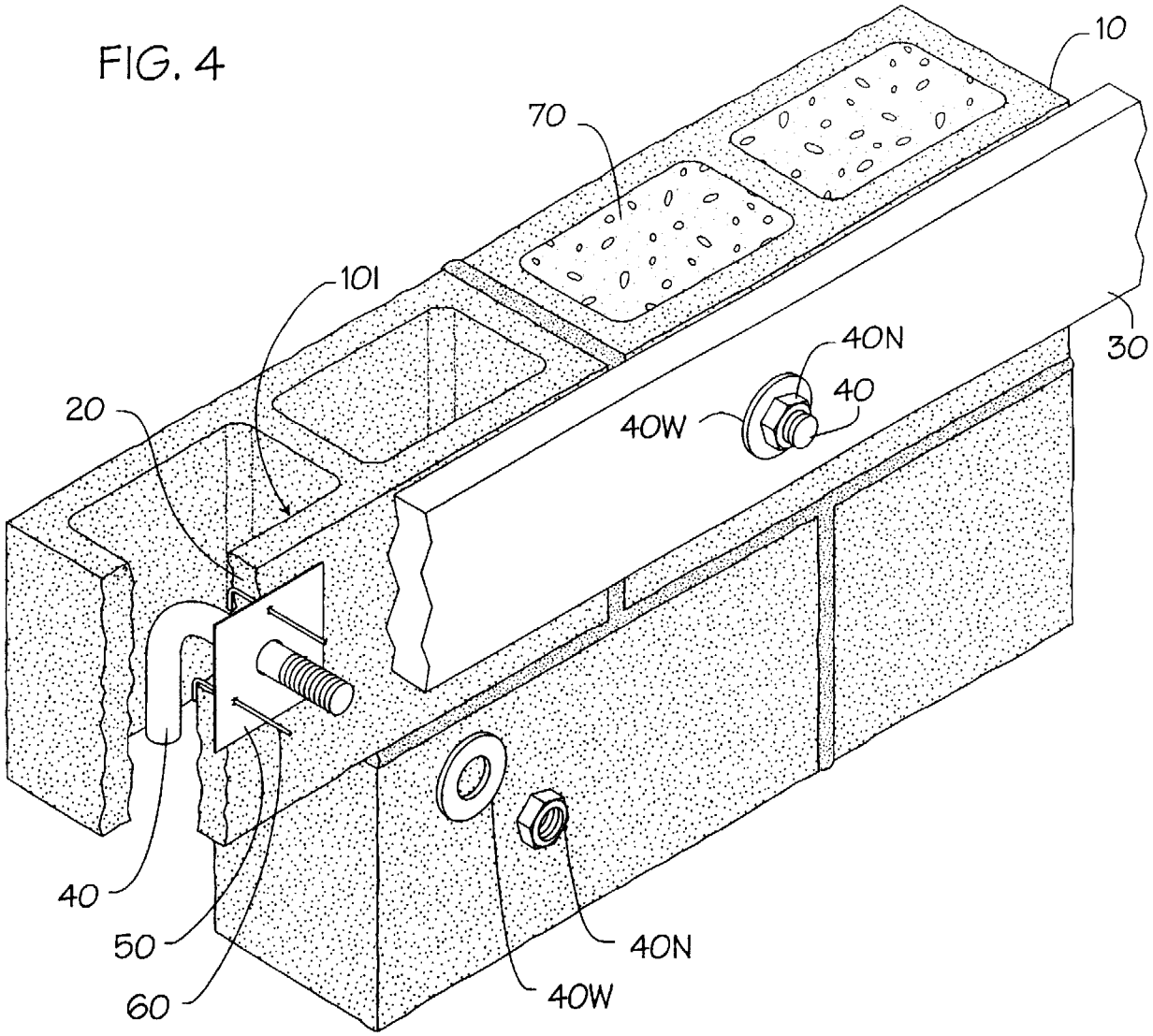
FIG. 4 is a perspective view of the preferred embodiment of the present invention shown in partial breakaway to teach the important details of the invention as mounted onto a masonry wall and how the invention relates to the mounting of a wood base sill.

The masonry wall 10 has a plurality of mounting holes 20 arranged linearly so as to mount a wood frame sill 30. A plurality of the anchor bolts 40 are positioned, one into each of the mounting holes 20. Each of the anchor bolts 40 is supported by a flat plate 50 of a stiff, preferably spring material, whereby each flat plate 50 includes a clearance hole 50C for passing one of the anchor bolts 40, and a plurality of hook mounting holes 50H, the hook mounting holes 50H being arranged around the clearance hole 50C on a concentric diameter 50D. A plurality of wire hooks 60 are provided but must include a minimum of three such hooks 60. Each of the hooks 60 has a first leg 60A, and a second contiguous leg 60B positioned generally at a right angle to the first leg 60A. Each of the hook mounting holes 50H accepts the first leg 60A of one of the hooks 60 inserted therein and provides a means for retarding 50R the movement of the first leg 60A of the hook 60 in a first direction D1 within the hook mounting hole 50H while permitting the movement of the first leg 60A of the hook in a second direction D2, reverse or opposite with respect to the first direction D1. Each of the hooks 60 has a length 60L which is long enough to allow the second leg 60B to engage an interior surface 10I of the masonry wall 10 so as to hold the plate 50 in place over one of the mounting holes 20. When the plates 50 are in place over the mounting holes 20 and pressed against the wall 10, the wire hooks 60 are revolved to that second legs 60B are positioned behind wall 10 and then the hooks 60 are drawn outward until the second legs 60B are in contact with the interior surface 10I. The plates 50 are now secured against the wall 10 and the clearance hole 50C is centered over the mounting hole 20, so that the anchor bolts 40 are secured by the plates 50, the bolts 40 are centered within the mounting holes 20, and grout 70 may now be poured into the masonry to secure the bolts 40. The wood plate 30 may then be mounted onto the bolts 40 after snipping off that portion of the wire hooks that protrudes from the wall 10. The plate 30 is held onto the wall by washers and nuts 40W and 40N on each of the bolts 40 as shown in FIG. 4. It is important to note that the wire hooks 60 are positioned against the sides of the mounting holes 20 in the masonry wall 10. This forces the bolt 40 in the clearance hole 50C to be centered within the mounting hole 20. The plate 50 is made of a thin sheet stock so it may be sandwiched between the wall 10 and the wood plate 30.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A masonry wall structure for mounting a wall plate, the structure comprising:

a hollow masonry wall providing a front surface and, spaced apart therefrom, a rear surface, the masonry wall further providing a bolt mounting hole therein, the bolt mounting hole providing a bolt mounting hole diameter;

an anchor bolt positioned centrally within the mounting hole and extending outwardly therefrom;

a flat plate of a stiff sheet material, the flat plate laying in contact with the front surface of the wall, the plate having a clearance hole therein, and a plurality of hook mounting holes arranged on a diameter concentric with the clearance hole, the diameter being approximately equal to the bolt mounting hole diameter;

a plurality of wire hooks, each of the wire hooks having a first leg, and a second contiguous leg positioned generally at a right angle to the first leg, the first leg of each of the wire hooks being frictionally engaged in one of the hook mounting holes and extending through the bolt mounting hole into the masonry wall so that, together, the first legs of the wire hooks position the flat plate on the front surface such that the clearance hole in the flat plate is concentric with the mounting hole;

the second leg of each of the hooks laying in contact with the rear surface of the wall so that the flat plate is held tightly against the front surface thereof with the anchor bolt centered within the bolt mounting hole;

a grout filling the hollow masonry wall and laying in contact with the flat plate and further, between the anchor bolt and the bolt mounting hole.

2. The device of claim 1 wherein each of the hook mounting holes provides a pair of opposing flaps cut into the flat plate and directed to one side thereof, a pair of opposing lips of the flaps being positioned in sliding contact with the first leg of one of the hooks such that the first leg is able to slide in only one direction within the hole.

* * * * *